US007697868B2

(12) United States Patent
Kim

(10) Patent No.: US 7,697,868 B2
(45) Date of Patent: Apr. 13, 2010

(54) COLOR IMAGE FORMING APPARATUS AND IMAGE FORMING UNIT THEREOF

(75) Inventor: Kyung Hwan Kim, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 228 days.

(21) Appl. No.: 12/034,033

(22) Filed: Feb. 20, 2008

(65) Prior Publication Data

US 2008/0240784 A1 Oct. 2, 2008

(30) Foreign Application Priority Data

Mar. 26, 2007 (KR) ..... 10-2007-0029460

(51) Int. Cl.
*G03G 15/00* (2006.01)

(52) U.S. Cl. ..... 399/167

(58) Field of Classification Search ..... 399/117, 399/167, 299, 302

See application file for complete search history.

(56) References Cited

U.S. PATENT DOCUMENTS 5,515,154 A * 5/1996 Hasegawa et al. ..... 399/303

5,905,927 A * 5/1999 Inoue et al. ..... 399/167

FOREIGN PATENT DOCUMENTS

JP 11-52651 2/1999
JP 2001-22150 1/2001

* cited by examiner

*Primary Examiner*—Hoang Ngo
(74) *Attorney, Agent, or Firm*—Staas & Halsey LLP

(57) ABSTRACT

A color image forming apparatus and an image forming unit thereof, the color image forming apparatus including: photosensitive bodies; a transfer drum to rotate while contacting the photosensitive bodies; a transfer device to transfer visible images overlapped on the transfer drum from the photosensitive bodies onto a printing medium; a photosensitive body driving gear to rotate with the transfer drum, and having a radius smaller than the transfer drum and having a same rotational center as the transfer drum; and photosensitive body gears coupled to the respective photosensitive bodies to be engaged with the photosensitive body driving gear, each of the photosensitive body gears having a radius larger than that of the photosensitive bodies. Accordingly, a size of each of the photosensitive body gears can be larger than that of each of the photosensitive bodies, and thus the photosensitive bodies can rotate stably.

29 Claims, 3 Drawing Sheets

COLOR IMAGE FORMING APPARATUS AND IMAGE FORMING UNIT THEREOF

CROSS-REFERENCE TO RELATED APPLICATION

This application claims the benefit of Korean Application No. 2007-29460, filed Mar. 26, 2007 in the Korean Intellectual Property Office, the disclosure of which is incorporated herein by reference.

BACKGROUND OF THE INVENTION

1. Field of the Invention

Aspects of the present invention relate to an image forming apparatus, and more particularly to a color image forming apparatus that is provided with plural photosensitive bodies on which visible images are formed, and forms a color visible image by overlapping the visible images of respectively different colors formed on the respective photosensitive bodies.

2. Description of the Related Art

An image forming apparatus is an apparatus that prints a black and white image or a color image on a printing medium (e.g., paper) according to an image signal. Examples of an image forming apparatus include a laser printer, an ink-jet printer, a copying machine, a multi-function printer, a fax machine, etc. An image forming apparatus is classified as an electrophotographic type or an ink-jet type. In the electrophotographic image forming apparatus, a beam is scanned onto a photosensitive body to form an electrostatic latent image and a developer is adhered to the electrostatic latent image to transfer the same onto a printing medium. In the ink-jet image forming apparatus, a liquid type ink is ejected onto a surface of a printing medium according to an image signal.

Furthermore, the electrophotographic image forming apparatus is configured such that a surface of a photosensitive body is charged with a predetermined electric potential, a beam is scanned onto the photosensitive body to form an electrostatic latent image due to an electric potential difference, and a developer is adhered to the electrostatic latent image to form a visible image. The visible image formed on the photosensitive body is transferred onto the printing medium, and is fixed to the surface of the printing medium by applying heat and pressure to the printing medium.

Such an electrophotographic image forming apparatus is classified as a mono image forming apparatus that prints a black and white image, or a color image forming apparatus that prints a color image. The mono image forming apparatus uses only a black developer and thus requires only a black developing device. However, the color image forming apparatus requires a plurality of developing devices, typically, of four colors (e.g., magenta, cyan, yellow and black) to form a color image.

There are two types of currently well-known electrophotographic color image forming apparatuses. Specifically, a multi-path type color image forming apparatus is provided with one photosensitive body, and a single-path type color image forming apparatus is provided with a plurality of photosensitive bodies corresponding to the respective developing devices.

The multi-path type color image forming apparatus is configured such that one developing device operates while one photosensitive body rotates once in order to form a visible image of one color on the photosensitive body. The visible image formed on the photosensitive body is then transferred before another developing device operates. The formation of the visible image of one color is repeated by the remaining developing devices. Therefore, the exposure process, the developing process and the transfer process are repeated four times in order to obtain a color image. In particular, the visible images of the respective colors are overlapped in order on the intermediate transfer device and transferred together onto the printing medium.

The single-path type color image forming apparatus is configured such that the visible images of the respective colors are formed in order on the respective photosensitive bodies provided corresponding to the respective developing devices at a slight time difference. Then, the visible images formed on the respective photosensitive bodies are transferred in order onto the intermediate transfer device or the printing medium at a slight time difference and overlapped. Therefore, the single-path type color image forming apparatus has an advantage that the image forming time is shorter than the multi-path type color image forming apparatus.

One example of the single-path type color image forming apparatus is disclosed in Japanese Patent Laid-open Publication No. 11-52651 (Feb. 26, 1999). The disclosed conventional single-path type color image forming apparatus is configured such that the visible images of the respective colors formed by four developing devices are transferred in order onto the printing medium fed by a belt, and overlapped on the printing medium. The developing devices are respectively provided with photosensitive bodies on which the visible images are formed. The photosensitive bodies are respectively provided with driving gears to transmit power. The driving gears of the respective photosensitive bodies are connected to one photosensitive body driving motor through gear trains including a plurality of gears.

However, in the above conventional color image forming apparatus, the power transmission mechanism is complicated because the photosensitive bodies are connected to the photosensitive body driving motor through a plurality of gears. Moreover, the gears should have small sizes due to limits of the mounting space. Thus, as modules of the gears are small, the loads applied to teeth of the gears are large, so that the teeth of the gears may be easily deformed or broken. Furthermore, the deformation or damage to the gears causes a printing error (such as jittering or banding) and a deterioration in printing quality.

Even more, the large number of power transmission gears causes an assembling error of the gears and, consequently, a rotational imbalance of the respective photosensitive bodies. Accordingly, a phase difference between the visible images transferred onto the printing medium becomes large, and a color registration error very possibly occurs.

SUMMARY OF THE INVENTION

Aspects of the present invention provide a color image forming apparatus that is provided with a power transmission mechanism for driving a plurality of photosensitive bodies, the power transmission mechanism having a simple structure and occupying a small mounting space so as to be manufactured compactly, and can decrease the occurrence of a printing error or a color registration error due to rotational unbalance of the photosensitive bodies.

According to an aspect of the present invention, there is provided a color image forming apparatus including: a plurality of photosensitive bodies, each photosensitive body having a visible image formed thereon and each visible image having a different color; a light scanning device to scan a beam onto the plurality of photosensitive bodies to form electrostatic latent images on each of the photosensitive bodies; a plurality of developing devices to adhere a respective developer to the plurality of photosensitive bodies to form the visible images of respectively different colors on each of the photosensitive bodies; a transfer drum to rotate while contacting the plurality of photosensitive bodies such that the visible images formed on the plurality of photosensitive bodies are transferred onto the transfer drum and overlapped; a transfer device to transfer the visible images overlapped on the transfer drum onto a printing medium; a motor to rotate the transfer drum; a photosensitive body driving gear to rotate with the transfer drum, wherein a radius of the photosensitive body driving gear is smaller than a radius of the transfer drum, and the photosensitive body driving gear and the transfer drum have a same rotational center; and a plurality of photosensitive body gears that are coupled to the respective photosensitive bodies to be engaged with the photosensitive body driving gear, wherein a radius of each of the photosensitive body gears is larger than a radius of each of the respective photosensitive bodies.

According to an aspect of the present invention, the color image forming apparatus may further include a transfer drum gear that is provided approximately to the transfer drum, and a first driving gear that is coupled to a motor shaft provided at the motor and engaged with the transfer drum gear.

According to an aspect of the present invention, the color image forming apparatus may further include a second driving gear that is coupled to the motor shaft and engaged with the photosensitive body driving gear, wherein the motor powers the motor shaft to simultaneously rotate the first driving gear and the second driving gear, causing the photosensitive body driving gear to rotate with the transfer drum.

According to an aspect of the present invention, the color image forming apparatus may further include a transfer drum shaft to rotatably support the transfer drum.

According to an aspect of the present invention, the photosensitive body driving gear may be coupled to the transfer drum shaft, and may rotate relative to the transfer drum shaft.

According to an aspect of the present invention, the transfer drum, the plurality of photosensitive bodies, the first driving gear, the second driving gear, the transfer drum gear, the photosensitive body driving gear, and the photosensitive body gears may be provided to satisfy:

$$(r1/r2)=((r4+r5)/Ri-1)\times(r3/r5)$$

where Ri refers to a radius of the transfer drum, r1 refers to a radius of a pitch circle of the first driving gear, r2 refers to a radius of a pitch circle of the second driving gear, r3 refers to a radius of a pitch circle of the transfer drum gear, r4 refers to a radius of a pitch circle of the photosensitive body driving gear, and r5 refers to a radius of a pitch circle of each of the photosensitive body gears.

According to an aspect of the present invention, the color image forming apparatus may further include a bearing that is mounted between the transfer drum shaft and the photosensitive body driving gear.

According to an aspect of the present invention, the photosensitive bodies and the transfer drum may be rotatably mounted to a frame.

According to an aspect of the present invention, the developing devices may be removably coupled to the frame.

According to yet another aspect of the present invention, there is provided an image forming unit of a color image forming apparatus, the image forming unit including: a frame; a plurality of photosensitive bodies that are rotatably mounted to the frame, each photosensitive body having a visible image formed thereon; a transfer drum that is rotatably mounted to the frame so as to rotate while contacting the plurality of photosensitive bodies, such that the visible images formed on the photosensitive bodies are transferred onto the transfer drum and overlapped; a motor to rotate the transfer drum; a photosensitive body driving gear to rotate with the transfer drum, wherein a radius of the photosensitive body driving gear is smaller than a radius of the transfer drum, and the photosensitive body driving gear and the transfer drum have a same rotational center; and a plurality of photosensitive body gears that are coupled to the respective photosensitive bodies to be engaged with the photosensitive body driving gear, wherein a radius of each of the photosensitive body gears is larger than a radius of each of the photosensitive respective bodies.

According to still another aspect of the present invention, there is provided an image forming unit of a color image forming apparatus, the image forming unit including: a plurality of photosensitive bodies that are rotatably mounted to a frame in the color image forming apparatus, each photosensitive body having a visible image formed thereon; a transfer drum that is rotatably mounted to the frame so as to rotate while contacting the plurality of photosensitive bodies, such that the visible images formed on the plurality of photosensitive bodies are transferred onto the transfer drum and overlapped; a photosensitive body driving gear to rotate with the transfer drum, wherein a radius of the photosensitive body driving gear is smaller than a radius of the transfer drum, and the photosensitive body driving gear and the transfer drum have a same rotational center; and a plurality of photosensitive body gears that are coupled to the respective photosensitive bodies to be engaged with the photosensitive body driving gear.

According to another aspect of the present invention, there is provided an image forming unit of a color image forming apparatus, the image forming unit including: a plurality of photosensitive bodies that are rotatably mounted to a frame in the color image forming apparatus, each photosensitive body having a visible image formed thereon; a transfer drum that is rotatably mounted to the frame so as to rotate while contacting the plurality of photosensitive bodies, such that the visible images formed on the plurality of photosensitive bodies are transferred onto the transfer drum and overlapped; a photosensitive body driving gear to rotate with the transfer drum; and a plurality of photosensitive body gears that are coupled to the respective photosensitive bodies to be engaged with the photosensitive body driving gear, wherein a radius of each of the photosensitive body gears is larger than a radius of each of the respective photosensitive bodies.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE EMBODIMENTS

Figure 1:
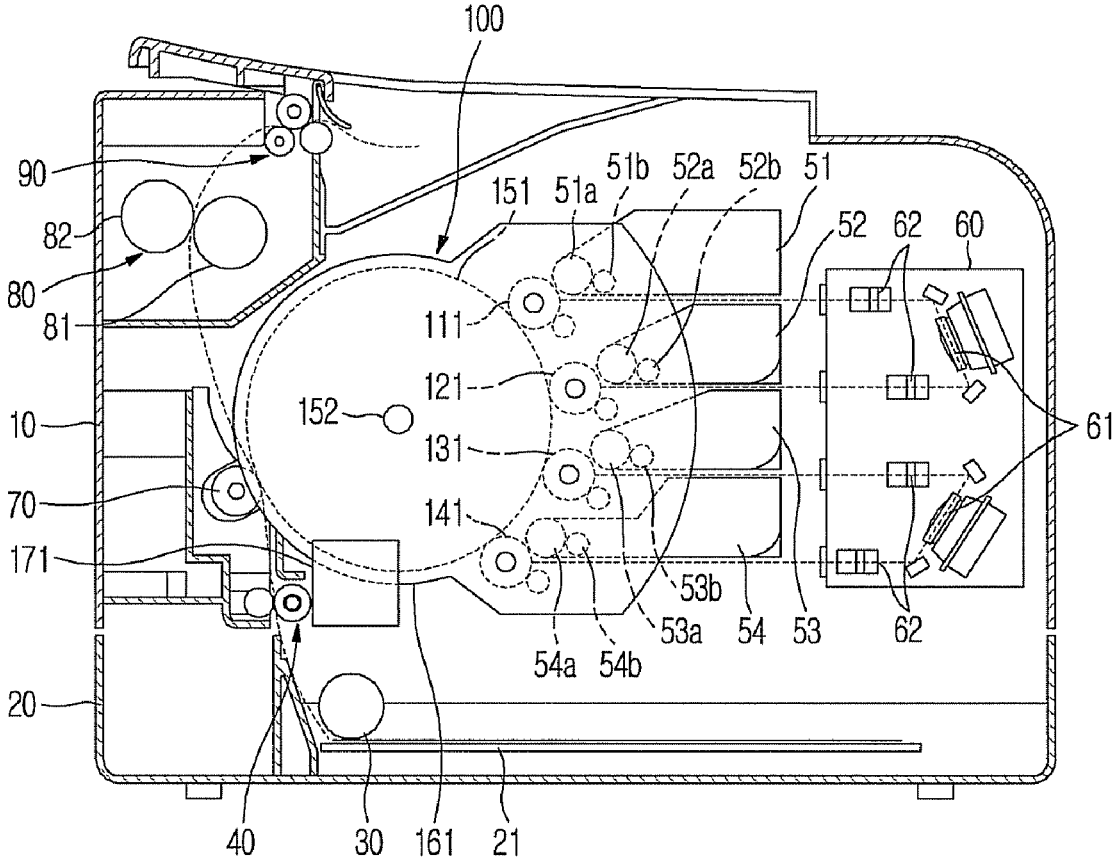
FIG. 1 is a side-sectional view schematically illustrating a color image forming apparatus according to an embodiment of the present invention.

Reference will now be made in detail to the present embodiments of the present invention, examples of which are illustrated in the accompanying drawings, wherein like reference numerals refer to like elements throughout. The embodiments are described below to explain the present invention by referring to the figures.

FIG. 1 is a side-sectional view schematically illustrating a color image forming apparatus according to an embodiment of the present invention. Referring to FIG.1, the color image forming apparatus is a single-path type color image forming apparatus that includes a plurality of photosensitive bodies 111, 121, 131 and 141 on which visible images of respectively different colors (e.g., magenta, cyan, yellow and black) are formed. Accordingly, the visible images formed on the respective photosensitive bodies 111, 121, 131 and 141 are overlapped to form a color image. However, it is understood that the colors can be other colors in addition to or instead of magenta, cyan, yellow, and black, and fewer or greater than 4 in number.

The color image forming apparatus further includes a main body 10, a printing medium supply device 20 on which a printing medium is loaded, a pickup device 30 to pick up the loaded printing medium sheet by sheet, a feeding device 40 to feed the picked-up printing medium, and an image forming unit 100. The image forming unit 100 has the plurality of photosensitive bodies 111, 121, 131 and 141 and a transfer drum 151. A plurality of developing devices 51, 52, 53 and 54 adhere a developer to the respective photosensitive bodies 111, 121,131 and 141. A light scanning device 60 scans a beam to the respective photosensitive bodies 111, 121, 131 and 141. A transfer device 70 transfers a color image formed on the transfer drum 151 onto the printing medium. A fixing unit 80 fixes the color image to the printing medium by applying heat and pressure to the color image-transferred printing medium. A discharge device 90 discharges the printing medium that has passed through the fixing unit 80.

Since the printing medium supply device 20, the pickup device 30, the feeding device 40, the light scanning device 60, the transfer device 70, the fixing unit 80 and the discharge device 90 are the same as those of a typical color image forming apparatus, the explanation thereof will be briefly made.

If the printing operation is initiated, the pickup device 30 operates to pick up the printing medium loaded on the printing medium supply device 20 sheet by sheet. The pickup device 30 rotates at a fixed position while a loading plate 21 provided in the printing medium supply device 20 lifts up the printing medium to the pickup device 30 so that the pickup device 30 can successively pick up the printing medium loaded on the loading plate 21. Once the printing medium that is picked up by the pickup device 30 is fed to the feeding device 40, the feeding device 40 registers the front end of the printing medium and feeds the printing medium toward the image forming unit 100.

While the printing medium is fed to the image forming unit 100, charging devices 114, 124, 134 and 144 (illustrated in FIG. 2) mounted adjacent to the respective photosensitive bodies 111, 121, 131 and 141 charge the surfaces of the photosensitive bodies 111, 121, 131 and 141 with a predetermined electric potential. Furthermore, the light scanning device 60 scans a beam to the photosensitive bodies 111, 121, 131 and 141 according to an image signal to form electrostatic latent images on the surfaces of the respective photosensitive bodies 111, 121, 131 and 141. The light scanning device 60 includes a light source (not shown) to generate the beam, polygon mirrors 61 to deflect the beam within a predetermined angle range, and f-theta lenses 62 to scan the beam toward the photosensitive bodies 111, 121,131 and 141 at a uniform velocity.

If the electrostatic latent images are formed on the respective photosensitive bodies 111, 121, 131 and 141, the respective developing devices 51, 52, 53 and 54, which contain developers of respectively different colors (e.g., magenta, cyan, yellow and black), adhere the developers to the respective photosensitive bodies 111, 121, 131 and 141 to form the visible images of respectively different colors. The visible images of different colors are transferred in order onto the rotating transfer drum 151. Accordingly, the color image is formed on the transfer drum 151 by the visible images of different colors being overlapped. The developing devices 51, 52, 53 and 54 include developing rollers 51*a*, 52*a*, 53*a* and 54*a* that adhere the developers to the photosensitive bodies 111, 121, 131 and 141. The developing devices 51, 52, 53, and 54 further include supply rollers 51*b*, 52*b*, 53*b* and 54*b* that supply the developers to the developing rollers 51*a*, 52*a*, 53*a* and 54*a*.

The color image formed on the transfer drum 151 is transferred onto the surface of the printing medium while the printing medium passes between the transfer drum 151 and the transfer device 70. When the color image-transferred printing medium is fed to the fixing unit 80, the fixing unit 80 applies heat and pressure to the printing medium to fuse the color image having the powder type developer to the surface of the printing medium. The fixing unit 80 includes a heating roller 81 that is provided with a heat source (not shown), and a press roller 82 that is in close contact with the heating roller 81.

After passing through the fixing unit 80, the printing medium is discharged to an outside of the main body 10 by the discharge device 90.

The image forming unit 100 includes the plurality of photosensitive bodies 111, 121, 131 and 141, the transfer drum 151, a frame 161 (shown in FIG. 2) that rotatably supports the photosensitive bodies 111,121, 131 and 141 and the transfer drum 151, and a motor 171 that drives the transfer drum 151 and the photosensitive bodies 111, 121, 131 and 141.

Figure 2:
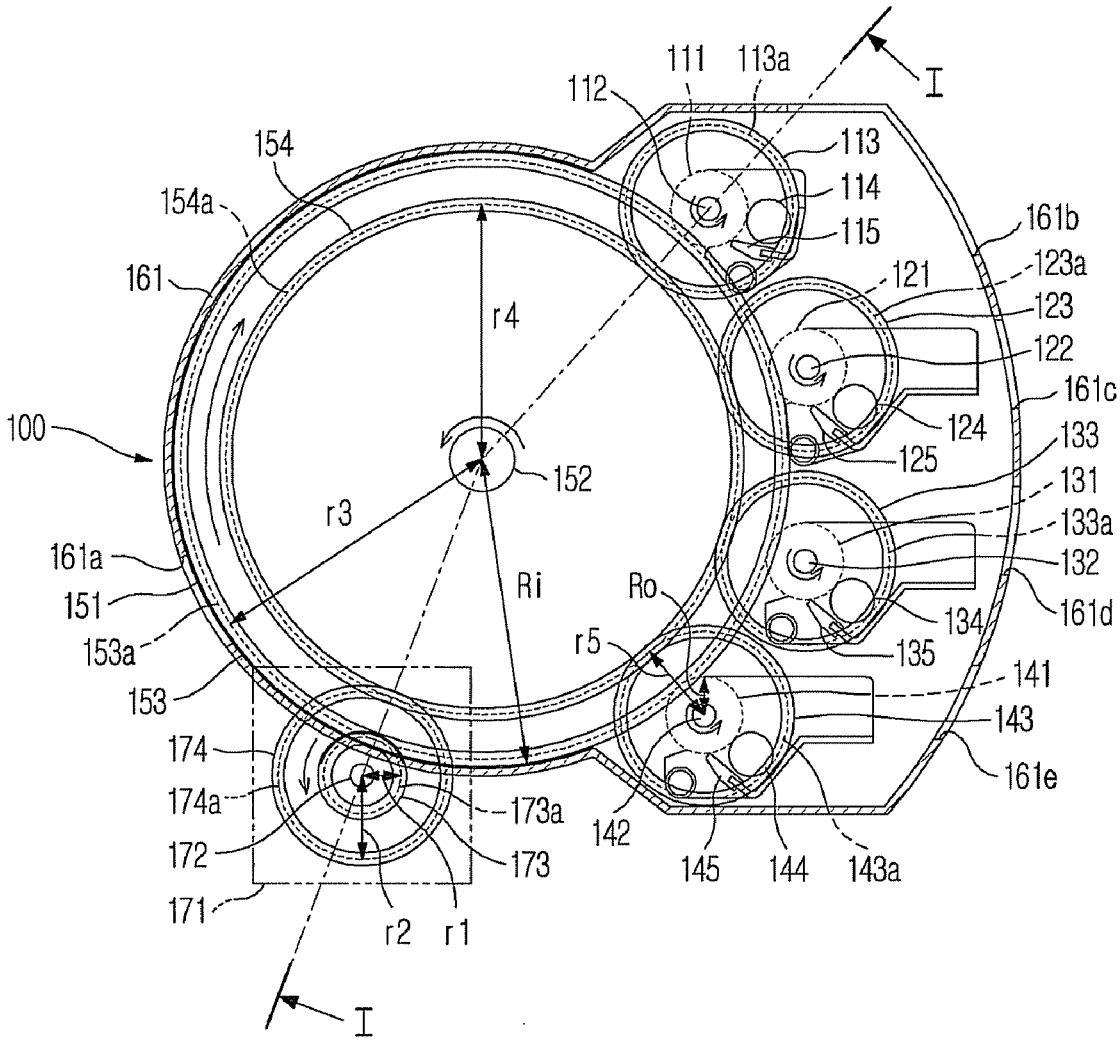
FIG. 2 is a side-sectional view schematically illustrating an image forming unit of the color image forming apparatus according to an embodiment of the present invention.

As shown in FIG. 2, the photosensitive bodies 111, 121, 131 and 141 and the transfer drum 151 are rotatably supported by the frame 161. The transfer drum 151 is integrally coupled to a transfer drum shaft 152, and the transfer drum shaft 152 is rotatably supported by a support bearing 162 (illustrated in FIG. 3) that is mounted to the frame 161. The photosensitive bodies 111, 121, 131 and 141 are respectively provided with photosensitive body shafts 112, 122, 132 and 142, and the photosensitive body shafts 112,122,132 and 142 are rotatably supported by support bearings 163 (illustrated in FIG. 3) that are mounted to the frame 161.

The frame 161 is provided with an opening 161*a* through which the transfer device 70 (see FIG. 1) contacts the transfer drum 151. The frame 161 further includes coupling holes 161*b*, 161*c*, 161*d* and 161*e* through which the developing devices 51, 52, 53 and 54 are respectively coupled to the image forming unit 100. It is illustrated in the Figures that the developing devices 51, 52, 53 and 54 are removably coupled to the frame 161. However, it is understood that aspects of the present invention are not limited thereto, and the developing devices 51, 52, 53 and 54 may be integrally coupled to the frame 161.

Figure 3:
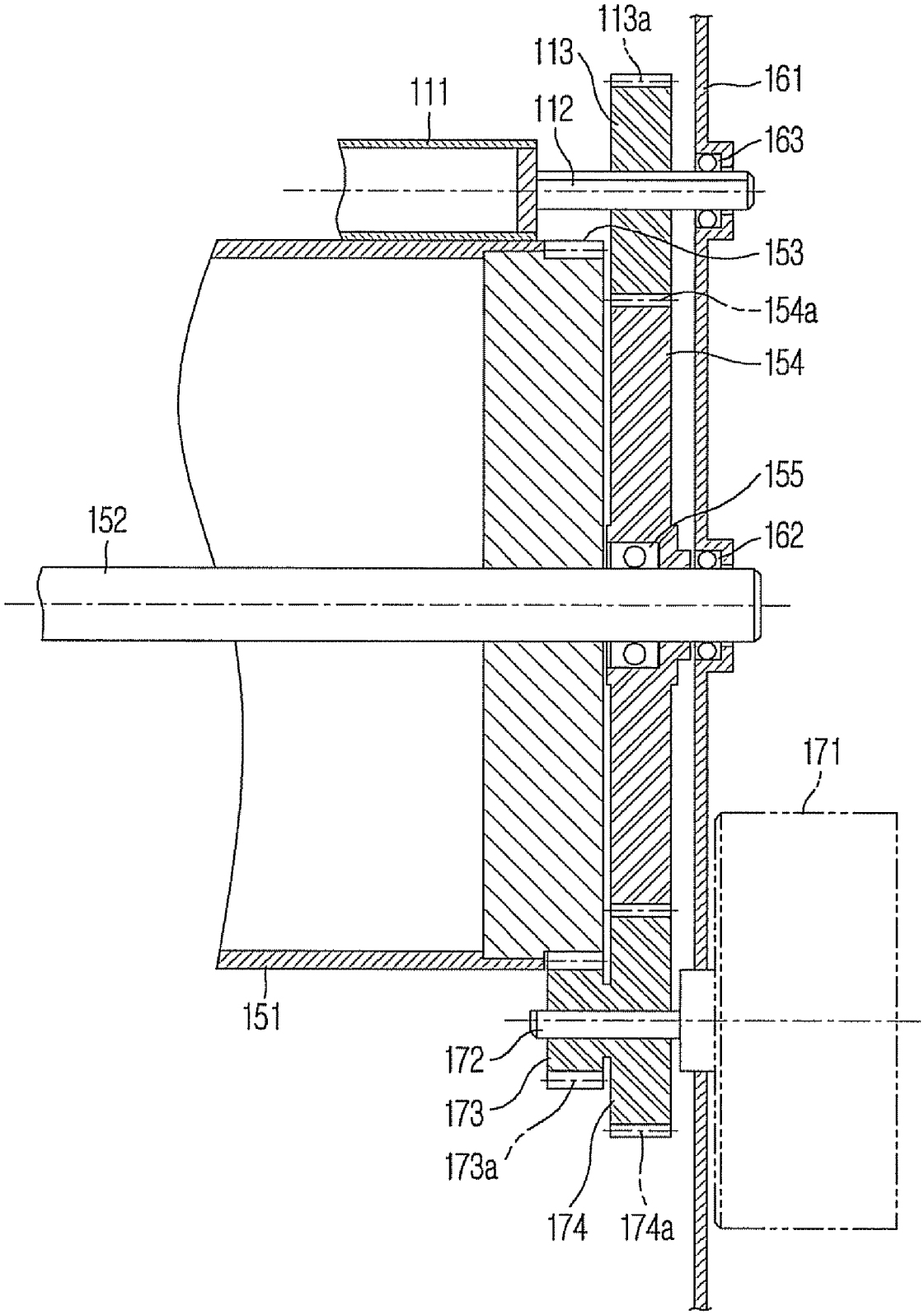
FIG. 3 is a sectional view taken along line I-I in FIG. 2.

As shown in FIGS. 2 and 3, all of the photosensitive bodies 111, 121, 131 and 141 have the same radius Ro, and are mounted to contact the outer periphery of the transfer drum 151 while being spaced apart from each other. The charging devices 114, 124, 134 and 144 are mounted around the respective photosensitive bodies 111, 121, 131, and 141 to charge the photosensitive bodies 111, 121, 131 and 141 with a predetermined electric potential. Furthermore, cleaners 115, 125, 135 and 145 are also mounted around the respective photosensitive bodies 111, 121, 131, and 141 to remove residual developer on the photosensitive bodies 111, 121, 131 and 141 without being transferred onto the transfer drum 151. Photosensitive body gears 113, 123, 133 and 143 are integrally coupled to the respective photosensitive body shafts 112, 122, 132 and 142. Accordingly, if the photosensitive body gears 113, 123, 133 and 143 rotate, the photosensitive body shafts 112, 122, 132 and 142 and the photosensitive bodies 111, 121, 131 and 141 rotate together therewith. The photosensitive body gears 113, 123, 133 and 143 are engaged with a photosensitive body driving gear 154, which will be described below.

While not required in all aspects, the transfer drum 151 may be structured such that a semi-conductive rubber is coupled to a hollow conductive drum. Chlorprene rubber (CR), ethylene propylene diene monomer (EPDM), nitrile-butadiene rubber (NBR), natural rubber (NR), or silicone rubber may be used as the semi-conductive rubber of the transfer drum 151. The surface of the transfer drum 151 may be coated with urethane or fluoro rubber (FR) with a thickness of 0.01 to 0.02 mm, to improve the release of the developer. The transfer drum 151 may have a resistance in the range of 10E7 Ω cm to 10E9 Ω cm. A transfer drum gear 153 is integrally coupled to the transfer drum shaft 152, approximately to the transfer drum 151. Accordingly, if the transfer drum gear 153 rotates, the transfer drum shaft 152 and the transfer drum 151 rotate together therewith.

The motor 171 is mounted to the frame 161. A first driving gear 173 for rotating the transfer drum 151 and a second driving gear 174 for rotating the photosensitive bodies 111, 121, 131 and 141 are integrally coupled to a motor shaft 172 provided at the motor 171. The first driving gear 173 is engaged with the transfer drum gear 153, and the second driving gear 174 is engaged with the photosensitive body driving gear 154. The photosensitive body driving gear 154 is rotatably coupled to the transfer drum shaft 152, and a support bearing 155 for supporting the photosensitive body driving gear 154 is mounted between the photosensitive body driving gear 154 and the transfer drum shaft 152. The photosensitive body driving gear 154 rotates at a speed different from the rotational speed of the transfer drum 151 and the transfer drum gear 153.

The photosensitive body driving gear 154 has a smaller size than that of the transfer drum 151 and the transfer drum gear 153. Accordingly, the photosensitive body gears 113, 123, 133 and 143 engaged with the photosensitive body driving gear 154 have a larger size than that of the photosensitive bodies 111, 121, 131 and 141. Furthermore, as the size of the photosensitive body driving gear 154 decreases, the size of the photosensitive body gears 113, 123, 133 and 143 can be increased. The second driving gear 174 engaged with the photosensitive body driving gear 154 has a larger size than that of the first driving gear 173 engaged with the transfer drum gear 153.

The respective gears 113, 123, 133, 143, 153, 154, 173, and 174 for rotating the transfer drum 151 and the photosensitive bodies 111, 121, 131 and 141 have sizes that satisfy the conditions by which the visible images formed on the photosensitive bodies 111, 121, 131 and 141 can be smoothly transferred onto the transfer drum 151. The above conditions may be expressed by the following equations related to the photosensitive bodies 111, 121, 131 and 141, the transfer drum 151 and the respective gears 113, 123, 133, 143, 153, 154, 173, and 174.

A linear velocity Vi of the transfer drum 151 may be equal to a linear velocity Vo of each of the photosensitive bodies 111, 121, 131 and 141, from which the following equation 1 is derived.

$$Ro \times \omega o = Ri \times \omega i \quad \text{(Equation 1)}$$

where Ro is a radius of each of the photosensitive bodies 111, 121, 131 and 141, ωo is an angular velocity of each of the photosensitive bodies 111, 121, 131 and 141, Ri is a radius of the transfer drum 151, and ωi is an angular velocity of the transfer drum 151.

A linear velocity Vig of a pitch circle 153*a* of the transfer drum gear 153 may be equal to a linear velocity Vg1 of a pitch circle 173*a* of the first driving gear 173 engaged with the transfer drum gear 153, from which the following equation 2 is derived.

$$r3 \times \omega i = r1 \times \omega m \quad \text{(Equation 2)}$$

where r3 is a radius of the pitch circle of the transfer drum gear 153, r1 is a radius of the pitch circle of the first driving gear 173, and ωm is an angular velocity of the motor 171.

A linear velocity Vg2 of a pitch circle 174*a* of the second driving gear 174 that is engaged with a pitch circle 154*a* of the photosensitive body driving gear 154 may be equal to a linear velocity Vog of each of the pitch circles 113*a*, 123*a*, 133*a* and 143*a* of the photosensitive body gears 113, 123, 133 and 143 that are engaged with the pitch circle 154*a* of the photosensitive body driving gear 154, from which the following equation 3 is derived.

$$r2 \times \omega m = r5 \times \omega o \quad \text{(Equation 3)}$$

where r2 is a radius of the pitch circle of the second driving gear 174, and r5 is a radius of the pitch circle of each of the photosensitive body gears 113, 123, 133, 143.

A distance between a center of the transfer drum 151 and a center of the motor 171 may be regular, from which the following equation 4 is derived.

$$r4 + r2 = r3 + r1 \quad \text{(Equation 4)}$$

A sum of the radius r4 of the pitch circle 154*a* of the photosensitive body driving gear 154 and the radius r5 of each of the pitch circles 113*a*, 123*a*, 133*a* and 143*a* of the photosensitive body gears 113, 123, 133 and 143 may be equal to a sum of a radius Ri of the transfer drum 151 and a radius Ro of each of the photosensitive bodies 111, 121, 131 and 141, from which the following equation 5 is derived.

$$r4 + r5 = Ri + Ro \quad \text{(Equation 5)}$$

The following equations 6, 7 and 8 are derived from the equations 1, 2 and 3.

$$\omega o = (Ri/Ro) \times \omega i \quad \text{(Equation 6)}$$

$$\omega m = (r3/r1) \times \omega i \quad \text{(Equation 7)}$$

$$\omega m = (r5/r2) \times \omega o \quad \text{(Equation 8)}$$

The following equation 9 is derived from the equations 6, 7 and 8.

$$(Ri/Ro)=(r3\times r2)/(r1\times r5) \quad \text{(Equation 9)}$$

The following equation 10 is derived from the equations 4 and 5.

$$Ri+Ro=r1+r3+r5-r2 \quad \text{(Equation 10)}$$

The following equation 11 is derived from the equations 9 and 10.

$$(r1/r2)=((r4+r5)/Ri-1)\times(r3/r5) \quad \text{(Equation 11)}$$

By designing the photosensitive bodies 111, 121, 131 and 141, the transfer drum 151, and the respective gears 113, 123, 133, 143, 153, 154, 173, and 174 based on the above equations, the image forming unit 100, in which the visible images formed on the photosensitive bodies 111, 121, 131 and 141 can be smoothly transferred onto the transfer drum 151 and overlapped, can be obtained.

As shown in FIG. 2, if the motor 171 operates to rotate the motor shaft 172 in the counterclockwise direction, the first driving gear 173 rotates the transfer drum gear 153 in the clockwise direction while the second driving gear 174 rotates the photosensitive body driving gear 154, which has the same rotational center as the transfer drum gear 153, in the clockwise direction. Therefore, when the transfer drum 151 rotates, the photosensitive body driving gear 154 and the photosensitive body gears 113, 123, 133 and 143 engaged therewith rotate in the counterclockwise direction, and the photosensitive bodies 111, 121, 131 and 141 rotate at the substantially same linear velocity as the transfer drum 151 while contacting the transfer drum 151. Accordingly, the visible images of the respective colors formed on the photosensitive bodies 111, 121, 131 and 141 are smoothly transferred onto the surface of the transfer drum 151 and overlapped, thereby achieving the high quality color image.

The linear velocity Vi of the transfer drum 151 may be set to be higher than the linear velocity Vo of each of the photosensitive bodies 111, 121, 131 and 141 by about 0.3%. Such regulation of the linear velocity Vi of the transfer drum 151 can be achieved by slightly enlarging the size of the transfer drum 151.

As apparent from the above description, the color image forming apparatus according to aspects of the present invention includes a power transmission mechanism with a simple structure that occupies a small mounting space, because the photosensitive body gears 113, 123, 133 and 143 are engaged with the photosensitive body driving gear 154 having a same rotational center as the transfer drum 151. Accordingly, the photosensitive body gears 113, 123, 133 and 143 rotate together with the transfer drum 151 when the motor 171 operates. Also, because the photosensitive body driving gear 154 has a smaller size than that of the transfer drum 151, the size of each of the photosensitive body gears 113, 123, 133 and 143 can be enlarged to be larger than that of each of the photosensitive bodies 111, 121, 131, and 141. Accordingly, the photosensitive bodies 111, 121, 131, and 141 and the transfer drum 151 can be provided to be small in a unitary unit, whereas the size of each of the photosensitive body gears 113, 123, 133 and 143 can be enlarged, so that the photosensitive bodies 111, 121, 131, and 141 can rotate stably.

Furthermore, since the size of each of the photosensitive body gears 113, 123, 133 and 143 is enlarged, the deformation or the breakage of the gears can be prevented. As a result, a printing error (such as jittering or banding) due to the deformation or the breakage of the gears 113, 123, 133 and 143 can be prevented.

Even more, since the power transmission mechanism for rotating the photosensitive bodies 111,121, 131, and 141 has a simple structure, an assembling error, rotational unbalance of the photosensitive bodies 111, 121, 131, and 141, and a color registration error can be decreased, when compared to a conventional power transmission mechanism having a plurality of gears to rotate the photosensitive bodies.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A color image forming apparatus comprising:

a plurality of photosensitive bodies, each photosensitive body being disposed to have a visible image formed thereon and each visible image having a different color;

a light scanning device to scan a beam onto the plurality of photosensitive bodies to form electrostatic latent images on each of the photosensitive bodies;

a plurality of developing devices to adhere a respective developer to the plurality of photosensitive bodies to form the visible images of respectively different colors on each of the photosensitive bodies;

a transfer drum to rotate while contacting the plurality of photosensitive bodies such that the visible images formed on the plurality of photosensitive bodies can be transferred onto the transfer drum and overlapped;

a transfer device to transfer the visible images overlapped on the transfer drum onto a printing medium;

a motor to rotate the transfer drum;

a photosensitive body driving gear to rotate with the transfer drum, wherein a radius of the photosensitive body driving gear is smaller than a radius of the transfer drum, and the photosensitive body driving gear and the transfer drum have a same rotational center; and a plurality of photosensitive body gears that are coupled to the respective photosensitive bodies and are engaged with the photosensitive body driving gear, wherein a radius of each of the photosensitive body gears is larger than a radius of each of the respective photosensitive bodies.

2. The color image forming apparatus as claimed in claim 1, further comprising:

a transfer drum gear to rotate the transfer drum, the transfer drum gear provided approximately to the transfer drum; and a first driving gear coupled to a motor shaft provided at the motor to rotate the first driving gear, the first driving gear being engaged with the transfer drum gear to rotate the transfer drum gear.

3. The color image forming apparatus as claimed in claim 2, further comprising:

a second driving gear coupled to the motor shaft and engaged with the photosensitive body driving gear to rotate the photosensitive body driving gear, wherein the motor powers the motor shaft to simultaneously rotate the first driving gear and the second driving gear, causing the photosensitive body driving gear to rotate with the transfer drum.

4. The color image forming apparatus as claimed in claim 3, further comprising:

a transfer drum shaft to rotatably support the transfer drum and the photosensitive body driving gear.

5. The color image forming apparatus as claimed in claim 4, wherein the photosensitive body driving gear is coupled to the transfer drum shaft and rotates relative to the transfer drum shaft.

6. The color image forming apparatus as claimed in claim 4, wherein the transfer drum, the plurality of photosensitive bodies, the first driving gear, the second driving gear, the transfer drum gear, the photosensitive body driving gear, and the photosensitive body gears are provided to satisfy:

$$(r1/r2)=((r4+r5)/Ri-1)\times(r3/r5)$$

where Ri is a radius of the transfer drum, r1 is a radius of a pitch circle of the first driving gear, r2 is a radius of a pitch circle of the second driving gear, r3 is a radius of a pitch circle of the transfer drum gear, r4 is a radius of a pitch circle of the photosensitive body driving gear, and r5 is a radius of a pitch circle of each of the photosensitive body gears.

7. The color image forming apparatus as claimed in claim 4, further comprising:

a bearing mounted between the transfer drum shaft and the photosensitive body driving gear to support the photosensitive body driving gear.

8. The color image forming apparatus as claimed in claim 1, further comprising a frame to rotatably mount the plurality of photosensitive bodies and the transfer drum.

9. The color image forming apparatus as claimed in claim 8, wherein the plurality of developing devices are removably coupled to the frame.

10. The color image forming apparatus as claimed in claim 2, wherein the radius of the photosensitive body driving gear is smaller than a radius of the transfer drum gear.

11. The color image forming apparatus as claimed in claim 3, wherein a radius of the second driving gear is larger than a radius of the first driving gear.

12. The color image forming apparatus as claimed in claim 3, wherein the motor operates to rotate the motor shaft in a first direction, causing the first driving gear to rotate the transfer drum gear in a second direction, opposite the first direction, and the second driving gear to rotate the photosensitive body driving gear in the second direction.

13. The color image forming apparatus as claimed in claim 2, wherein the transfer drum rotating gear, the photosensitive body driving gear, and the transfer drum have the same rotational center.

14. The color image forming apparatus as claimed in claim 1, wherein a linear velocity of the transfer drum is higher than a linear velocity of each of the photosensitive bodies.

15. An image forming unit of a color image forming apparatus, the image forming unit comprising:

a frame;

a plurality of photosensitive bodies that are rotatably mounted to the frame in the color image forming apparatus, each photosensitive body being disposed to have a visible image formed thereon;

a transfer drum that is rotatably mounted to the frame so as to rotate while contacting the plurality of photosensitive bodies, such that the visible images formed on the plurality of photosensitive bodies can be transferred onto the transfer drum and overlapped;

a photosensitive body driving gear to rotate with the transfer drum, wherein a radius of the photosensitive body driving gear is smaller than a radius of the transfer drum, and the photosensitive body driving gear and the transfer drum have a same rotational center; and a plurality of photosensitive body gears that are coupled to the respective photosensitive bodies and are engaged with the photosensitive body driving gear, wherein a radius of each of the photosensitive body gears is larger than a radius of each of the respective photosensitive bodies.

16. The image forming unit as claimed in claim 15, further comprising a motor to rotate the transfer drum.

17. The image forming unit as claimed in claim 16, further comprising:

a transfer drum gear to rotate the transfer drum, the transfer drum gear provided approximately to the transfer drum; and a first driving gear coupled to a motor shaft provided at the motor to rotate the first driving gear, the first driving gear being engaged with the transfer drum gear to rotate the transfer drum gear.

18. The image forming unit as claimed in claim 17, further comprising:

a second driving gear coupled to the motor shaft and engaged with the photosensitive body driving gear to rotate the photosensitive body driving gear, wherein the motor powers the motor shaft to simultaneously rotate the first driving gear and the second driving gear, causing the photosensitive body driving gear to rotate with the transfer drum.

19. The image forming unit as claimed in claim 18, further comprising:

a transfer drum shaft to rotatably support the transfer drum and the photosensitive body driving gear.

20. The image forming unit as claimed in claim 19, wherein the photosensitive body driving gear is coupled to the transfer drum shaft, and rotates relative to the transfer drum shaft.

21. The image forming unit as claimed in claim 19, wherein the transfer drum, the plurality of photosensitive bodies, the first driving gear, the second driving gear, the transfer drum gear, the photosensitive body driving gear, and the photosensitive body gears are provided to satisfy:

$$(r1/r2)=((r4+r5)/Ri-1)\times(r3/r5)$$

where Ri is a radius of the transfer drum, r1 is a radius of a pitch circle of the first driving gear, r2 is a radius of a pitch circle of the second driving gear, r3 is a radius of a pitch circle of the transfer drum gear, r4 is a radius of a pitch circle of the photosensitive body driving gear, and r5 is a radius of a pitch circle of each of the photosensitive body gears.

22. The image forming unit as claimed in claim 17, wherein the radius of the photosensitive body driving gear is smaller than a radius of the transfer drum gear.

23. The image forming unit as claimed in claim 18, wherein a radius of the second driving gear is larger than a radius of the first driving gear.

24. The image forming unit as claimed in claim 18, wherein the motor operates to rotate the motor shaft in a first direction, causing the first driving gear to rotate the transfer drum gear in a second direction, opposite the first direction, and the second driving gear to rotate the photosensitive body driving gear in the second direction.

25. The image forming unit as claimed in claim 17, wherein the transfer drum rotating gear, the photosensitive body driving gear, and the transfer drum have the same rotational center.

26. An image forming unit of a color image forming apparatus, the image forming unit comprising:

a frame;

a plurality of photosensitive bodies that are rotatably mounted to the frame in the color image forming apparatus, each photosensitive body being disposed to have a visible image formed thereon;

a transfer drum that is rotatably mounted to the frame so as to rotate while contacting the plurality of photosensitive bodies, such that the visible images formed on the plurality of photosensitive bodies can be transferred onto the transfer drum and overlapped;

a photosensitive body driving gear to rotate with the transfer drum, wherein a radius of the photosensitive body driving gear is smaller than a radius of the transfer drum, and the photosensitive body driving gear and the transfer drum have a same rotational center; and a plurality of photosensitive body gears that are coupled to the respective photosensitive bodies and are engaged with the photosensitive body driving gear.

27. An image forming unit of a color image forming apparatus, the image forming unit comprising:

a frame;

a plurality of photosensitive bodies that are rotatably mounted to the frame in the color image forming apparatus, each photosensitive body being disposed to have a visible image formed thereon;

a transfer drum that is rotatably mounted to the frame so as to rotate while contacting the plurality of photosensitive bodies, such that the visible images formed on the plurality of photosensitive bodies can be transferred onto the transfer drum and overlapped;

a photosensitive body driving gear to rotate with the transfer drum; and a plurality of photosensitive body gears that are coupled to the respective photosensitive bodies and are engaged with the photosensitive body driving gear, wherein a radius of each of the photosensitive body gears is larger than a radius of each of the respective photosensitive bodies.

28. The image forming unit as claimed in claim 27, wherein a radius of the photosensitive body driving gear is smaller than a radius of the transfer drum.

29. The image forming unit as claimed in claim 27, wherein the photosensitive body driving gear and the transfer drum have a same rotational center.

* * * * *